US005547419A

United States Patent [19]

Hulnicki

[11] Patent Number: 5,547,419

[45] Date of Patent: Aug. 20, 1996

[54] KNIVES AND SCISSORS SHARPENER

[76] Inventor: Andrew M. Hulnicki, 60 Old Town Rd., No. 99, Vernon, Conn. 06066

[21] Appl. No.: 298,271

[22] Filed: Aug. 31, 1994

[51] Int. Cl.[6] ..... B24B 3/48

[52] U.S. Cl. ..... 451/321; 451/320

[58] Field of Search ..... 451/45, 322, 321, 451/320, 555, 556, 380, 377, 367

[56] References Cited

U.S. PATENT DOCUMENTS

| | | | |
|---|---|---|---|
| D. 273,081 | 3/1984 | Levine | D8/93 |
| D. 297,504 | 9/1988 | Taylor | D8/91 |
| 523,908 | 7/1894 | Sly | 451/321 |
| 776,967 | 12/1904 | Van Tassel et al. | 451/321 |
| 785,593 | 3/1905 | Craig | 451/321 |
| 805,332 | 11/1905 | Yow | 451/321 |
| 816,662 | 4/1906 | Jeffrey | 451/321 |
| 828,853 | 8/1906 | Ives | 451/321 |
| 1,005,082 | 10/1911 | Sumner | 451/321 |
| 1,126,891 | 2/1915 | Sheppard | 451/45 |
| 1,605,784 | 11/1926 | Schmitt | 451/320 |
| 2,165,929 | 7/1939 | Lentz | 451/320 |
| 2,435,671 | 11/1944 | Clark et al. | 451/321 |
| 2,718,099 | 9/1955 | Thompson | 451/321 |
| 4,897,965 | 2/1990 | Friel . | |
| 4,915,709 | 4/1990 | Andrew et al. | 51/109 |
| 5,245,789 | 9/1993 | Roes et al. | 51/80 |

OTHER PUBLICATIONS

"Cabela's 1993 Fall Catalog"—p. 224.

*Primary Examiner*—Bruce M. Kisliuk
*Assistant Examiner*—Derris Banks
*Attorney, Agent, or Firm*—Ira S. Dorman

[57] ABSTRACT

Blade-sharpening apparatus includes a blade holder that is axially and pivotably movable on an upright post, to enable controlled manual movement of a clamped blade in contact with a sharpening stone supported on an underlying base. The means by which the clamping head is mounted permits adjustment of declination, for producing the desired blade-edge angle, and it permits pivoting of the head for maintaining optimal contact between the blade and the surface of the stone.

10 Claims, 2 Drawing Sheets

B
11
S
10
46
42
40
44
48
38
28
34
36
33
39
23
15°
25
22
14
18
23
24

KNIVES AND SCISSORS SHARPENER

BACKGROUND OF THE INVENTION

Various forms of apparatus for sharpening blades are disclosed in the U.S. patent art, exemplary of which are Friel U.S. Pat. No. 4,897,965, Andrew et al U.S. Pat. No. 4,915,709, Rees et al U.S. Pat. No. 5,245,789, Levine Des. 273,081, and Taylor Des. 297,504. Among the commercially available devices is a so-called GATCO sharpener, which comprises a system for guiding a honing stone over a clamped blade.

Despite the foregoing, a need is believed to exist for blade-sharpening apparatus that is facile to use and of incomplex and relatively inexpensive design and construction, and which is yet highly effective for producing sharp edges on the blades of knives, scissors, and/or other cutting implements.

SUMMARY OF THE DISCLOSURE

Accordingly, it is the broad object of the present invention to provide novel blade-sharpening apparatus which is facile to use and yet highly effective in producing sharp edges.

More specific objects of the invention are to provide such apparatus which is also of relatively incomplex and inexpensive design and construction, and is adapted for use in sharpening blades of knives, scissors and/or other cutting implements.

It has now been found that the foregoing and related objects of the invention are attained by the provision of apparatus comprising a base adapted to support sharpening means (e.g., a stone); a blade holder, including, in combination, a mounting member, a clamping member, and means attaching them to one another for relative pivotal movement about a first axis; and support means operatively associated with the base and supporting the blade holder. The support means and mounting member are cooperatively so constructed as to enable axial and pivotal movement of the blade holder on and about a second axis extending generally normal to the base. A blade held by the clamping member can therefore be lowered into contact with sharpening means supported on the base, and moved arcuately thereover, about the "second" axis, to effect sharpening. The attaching means serves to permit the maintenance of good contact between the blade and the sharpening member, by pivotal movement of the clamping member about the "first" axis.

The support means will usually comprise a post attached to the base and projecting therefrom on the "second" axis. Preferably, the support means will further comprise a mounting piece for supporting the blade holder, the mounting piece being slidably mounted on the post with the axis of its passageway coincident with the "second" axis. The mounting piece will normally be resiliently biased away from the base, and will most desirably be axially elongated to enable securement of the mounting member in selected positions along its length.

Both the clamping member and also the blade holder will usually be rotatable through an angle of at least 180°, about the "first" and "second" axes, respectively. The attaching means will advantageously be so constructed as to permit variable orientation of the clamping member by establishing a selected angle between the "first" and "second" axes, as may be achieved readily by attaching the clamping member to one end of a shaft that is pivotably attached to the mounting member; indicia may be provided for indicating the value of the angle between the axes.

DETAILED DESCRIPTION OF THE ILLUSTRATED EMBODIMENTS

Figure 1:
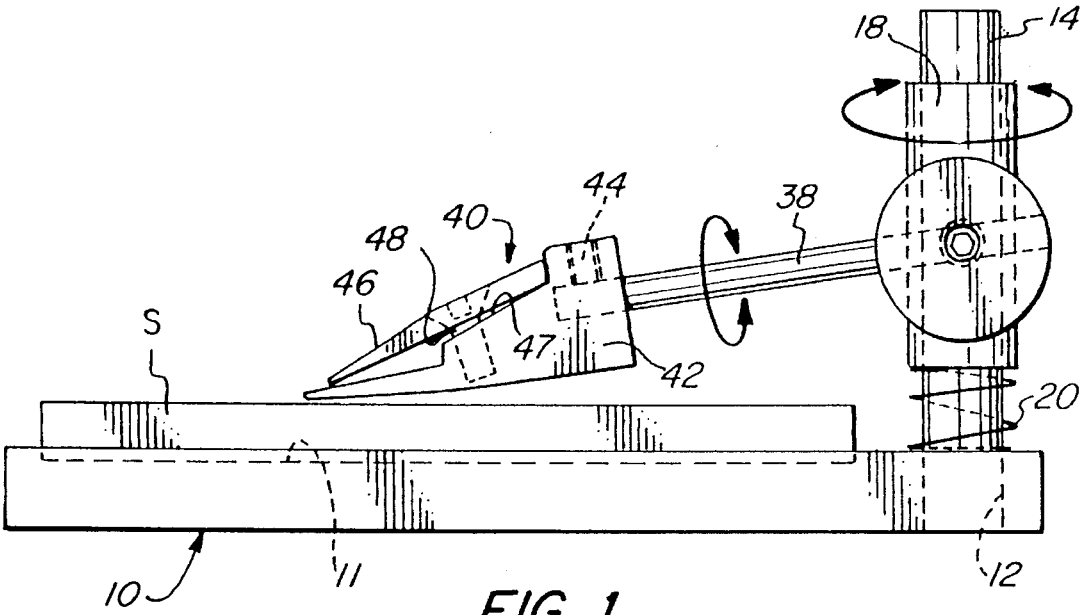
FIG. 1 is a side elevational of apparatus embodying the present invention.
Figure 2:
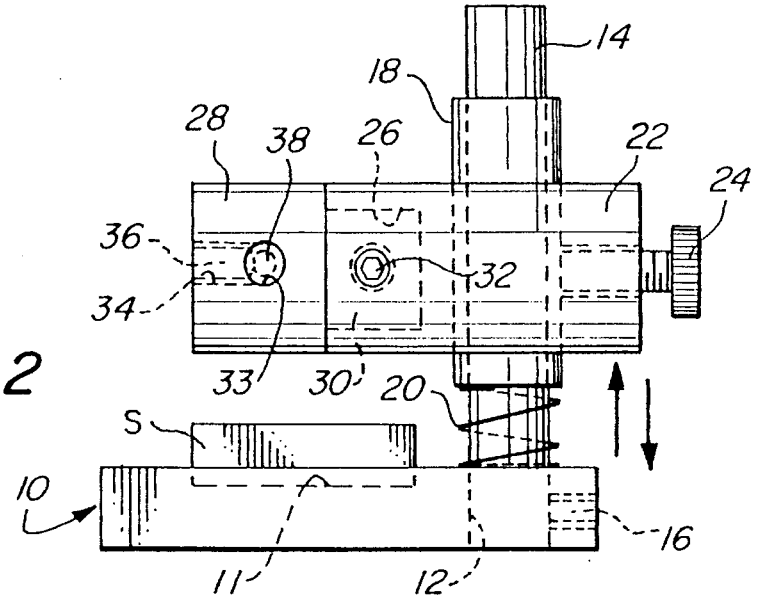
FIG. 2 is a rear elevational view of the apparatus of FIG. 1.
Figure 3:
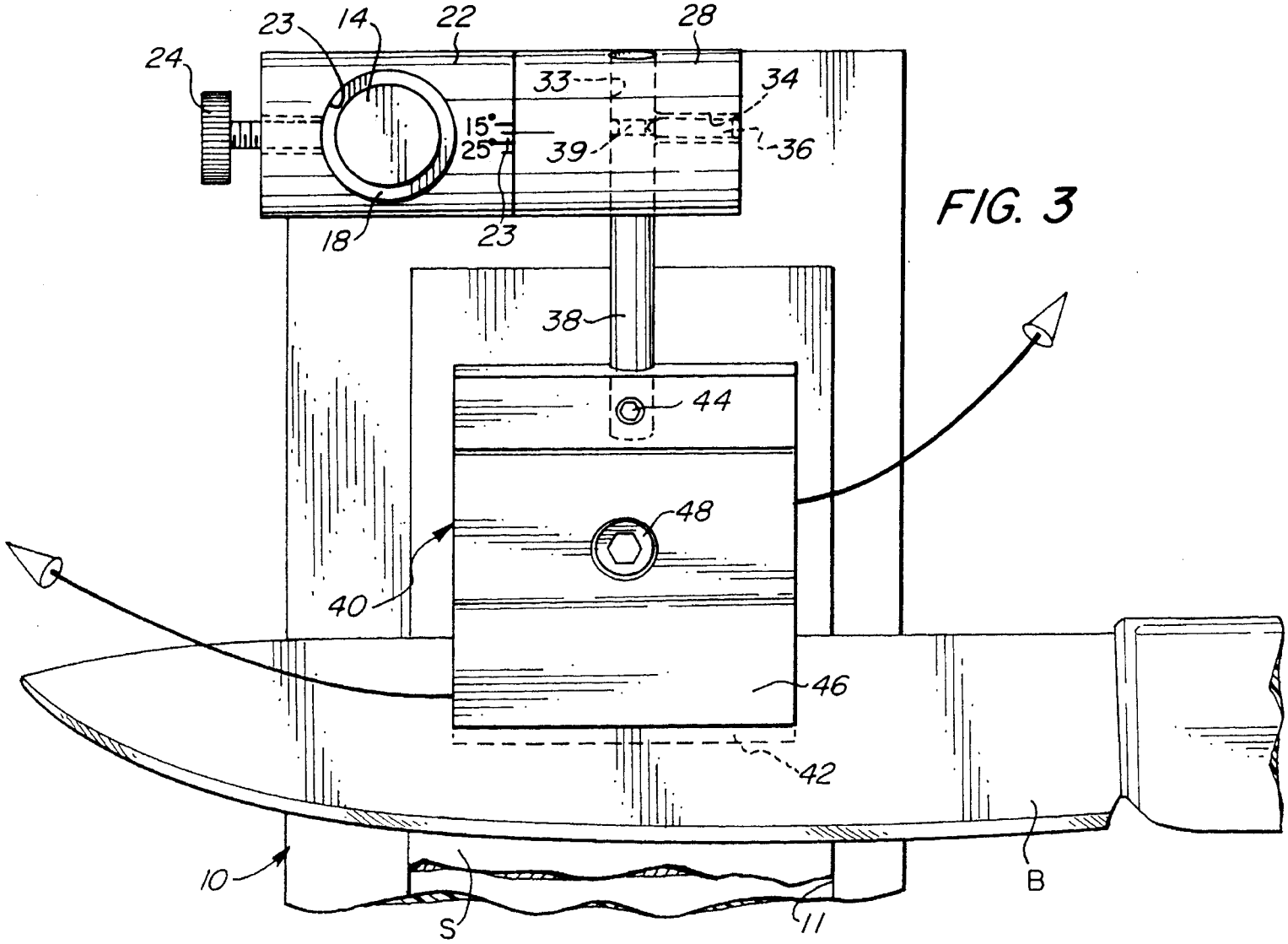
FIG. 3 is a plan view of the apparatus of the foregoing Figures, drawn to an enlarged scale and showing a knife clamped in position for sharpening of its blade.

Turning now in detail to FIGS. 1 through 3 of the drawings, therein illustrated is apparatus embodying the present invention and consisting of a base, generally designated by the numeral 10, having a recess 11 formed into its upper surface and seating a sharpening stone "S". A round hole 12 is formed through one corner of the base 10, and serves to receive and frictionally engage one end of a support post 14, which projects on an axis generally normal to the plane of the base 10; a set-screw 16 is engaged in a threaded aperture that extends laterally into one side of the base, and serves to fix the post 14 against inadvertent disassembly. The post 14 slidably mounts an elongated bushing or collar 18; a coil spring 20 surrounds the post 14 and bears upon the upper surface of the base 10 and the lower end of the bushing 18, thereby exerting an upward, resilient bias upon the bushing 18 and urging it away from the base.

The mounting assembly includes a body 22 and a head 28, the body 22 having a circular passage 23 extending diametrically through it. Bushing 18 is received in the passage 23, and is selectively engageable, through a range of relative positions, by tightening the thumb screw 24 against its outer surface. An axial socket 26 is formed into one end of the body 22 and serves to seat a cylindrical neck portion 30 on the head 28, thereby facilitating rotation of the head 28 relative to the body 22. A set-screw 32, engaged in a threaded aperture formed in the rear of the body 22, may be tightened against the neck portion 30 to secure the head 28 in a desired angular relationship. As will be noted, a scale 23 indicates a range of declination angles of 15° to 30°, which will be suitable for edges on most blades.

A passage 33 extends diametrically through the head 28, and is intersected by a small axial bore 34. The bore 34 seats a detent element 36 (schematically illustrated), which serves to engage the shaft 38 of a clamp member, generally designed by the numeral 40, to thereby mount the clamp member 40 on the head 28. A circumferential groove 39 is formed into the shaft 38, and receives the tip of the detent element 36 to prevent inadvertent disassembly while permitting full rotation of the shaft 38 about its longitudinal axis.

The clamp 40 includes of a lower jaw 42 attached to the free end of the shaft 38 and affixed thereon by a set-screw 44. The upper jaw 46 is seated within a recessed area 47 of the lower jaw 42, and is assembled therewith by a clamping screw 48.

As can be seen in FIG. 3, the blade "B" of a knife to be sharpened is inserted between the jaws 42, 46 of the clamp 40, and is secured in place by tightening screw 48. The blade "B" is sharpened by moving it arcuately in contact with the upper surface of the stone "S" with the bushing 18 pivoting on the post 14. Downward pressure, exerted against the counteracting force of the spring 20, will of course lower the mounting assembly and bring the blade "B" against the stone, with contact being optimally maintained, as the blade is swung on the post 14, by pivotal motion of the clamp 40 on the shaft 38.

Figure 4:
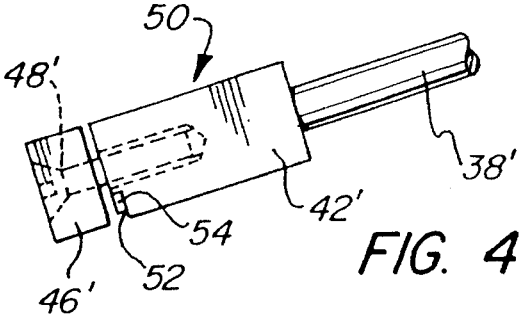
FIG. 4 is a fragmentary, side elevational view of a scissors clamp suitable for use in the apparatus of the invention.

FIG. 4 illustrates a second form of clamp, generally designated by the numeral 50, which is constructed to secure a scissors blade. It consists of a shaft 38' that carries cooperating jaws 42' and 46', assembled by clamping screw 48'. A notch 54 is formed along a lower corner of the jaw 42' and is defined in part by a downwardly facing ramp surface 52, for most securely seating the blade. The apparatus is used for sharpening scissors blades in the manner previously described, the sole exception being that the stone "S" would advantageously be repositioned to extend along one edge of the base 10, for most convenient and effective access.

Thus, it can be seen that the present invention provides novel blade-sharpening apparatus which is facile and yet highly effective to use. The apparatus is of relatively incomplex design and construction, and is adapted for producing sharp edges on blades of knives, scissors and/or other cutting implements.

Having thus described the invention, what is claimed is:

1. Blade-sharpening apparatus, comprising:

a base adapted to support sharpening means;

a blade holder including, in combination, a mounting member, a clamping member, and attaching means attaching said mounting and clamping members to one another for relative rotational movement of said clamping member through an angle of at least 180° about a first axis, said first axis extending between said mounting and clamping members, and said clamping member being so constructed as to dispose a clamped blade substantially in the plane in which said first axis extends; and support means operatively associated with said base and supporting said blade holder for movement of said clamping member over said base, said support means and mounting member being cooperatively so constructed as to enable both free reciprocal axial movement of said holder on, and also free rotational movement of said blade holder through an angle of at least 180° about, a second axis extending generally normal to said base, said mounting member including a body portion constructed to enable such free axial and rotational movement of said blade holder on and about said second axis, and a head portion attached to said body portion for relative rotation of said head portion about a third axis perpendicular to both of said first and second axis, said body portion and said head portion having cooperating means thereon to disengageably affix said attaching means with a selected variable angle between said first and second axes and about said third axis, so that a blade held by said clamping member can be lowered, by displacement of said blade holder on said second axis, into contact with sharpening means supported on said base, with said first axis extending generally outwardly at such selected angle from said second axis toward said base, and so that said clamping member can be moved arcuately over the sharpening means to effect sharpening of the blade, rotational movement of said clamping member about said first axis serving to permit the maintenance of good contact between the blade and the sharpening means.

2. The apparatus of claim 1 wherein said support means comprises a post attached to said base and projecting therefrom on said second axis.

3. The apparatus of claim 2 wherein said support means further comprises a mounting piece having an axial passageway, said mounting piece being slidably mounted on said post with the axis of said passageway coincident with said second axis, said mounting member of said blade holder being secured to said mounting piece for slidable movement therewith.

4. The apparatus of claim 3 wherein said mounting piece is elongated in the direction of said axial passageway, and wherein said mounting member is securable on said mounting piece in selected positions along the length thereof.

5. The apparatus of claim 4 further including biasing means resiliently biasing said mounting piece away from said base.

6. The apparatus of claim 1 wherein said attaching means is so constructed as to enable said clamping member to be variably oriented to establish a selected angle between said first and second axes.

7. The apparatus of claim 6 wherein said attaching means comprises a shaft having opposite ends to which said mounting member and clamping member are attached, respectively, said shaft being pivotably attached to said mounting member.

8. The apparatus of claim 6 additionally including indicia for indicating the value of said angle.

9. The apparatus of claim 1 wherein said clamping member is constructed for clamping blades selected from the group consisting of knife blades and scissors blades.

10. Blade-sharpening apparatus, comprising:

a base adapted to support sharpening means;

a blade holder including, in combination, a mounting member, a clamping member, and attaching means attaching said mounting and clamping members to one another for relative rotational movement of said clamping member through an angle of at least 180° about a first axis, said first axis extending between said mounting and clamping members, and said clamping member being so constructed as to dispose a clamped blade substantially in the plane in which said first axis extends; and support means operatively associated with said base and supporting said blade holder for movement of said clamping member over said base, said support means and mounting member being cooperatively so constructed as to enable both free reciprocal axial movement of said holder on, and also free rotational movement of said blade holder through an angle of at least 180° about, a second axis extending generally normal to said base, said support means including biasing means resiliently biasing said mounting member away from said base, said mounting member including a body portion constructed to enable such free axial and rotational movement of said blade holder on and about said second axis, and a head portion attached to said body portion for relative rotation of said head portion about a third axis perpendicular to both of said first and second axis, said body portion and said head portion having cooperating means thereon to disengagedly affix said attaching means with a selected variable angle between said first and second axes and about said third axis, so that a blade held by said clamping member can be lowered, by displacement of said blade holder on said second axis, into contact with sharpening means supported on said base, with said first axis extending generally outwardly at such selected angle from said second axis toward said base, and so that said clamping member cam be moved arcuately over the sharpening means to effect sharpening of the blade, rotational movement of said clamping member about said first axis serving to permit the maintenance of good contact between the blade and the sharpening means.

* * * * *